United States Patent [19]

Keller et al.

[11] 4,449,221

[45] May 15, 1984

[54] ORE-SMELTING ELECTRICAL FURNACE BATH

[76] Inventors: Viktor R. Keller, ulitsa Lenina, 4, kv. 48, poselok Pobugskoe, Golovanevsky raion, Kirovogradskaya oblast; Valery D. Linev, ulitsa Gertsena, 11/6, kv. 26, Leningrad; Sergei G. Mittsev, ulitsa Pirogova, 1, kv, 37, poselok Pobugskoe, Golovanevsky raion, Kirovogradskaya oblast; Mikhail Z. Zhivov, prospekt Engelsa, 28, kv. 107, Leningrad; Boris B. Pelts, ulitsa Lesnaya, 63/43, kv. 157, Moscow; Alexandr N. Popov, ulitsa Marshala Timoshenko, 28, kv. 58, Moscow; Vladimir L. Rozenberg, Leningradsky prospekt, 59, kv. 27, Moscow; Alexandr E. Burochkin, Pochtovy pereulok, 1, kv. 1, poselok Pobugskoe, Golovanevsky raion, Kirovogradskaya oblast; Jury A. Romanenkov, Svetlanovsky prospekt, 66, kv. 131; Boris P. Onischin, naberezhnaya reki Fontanki, 50, kv. 44, both of Leningrad, all of U.S.S.R.

[21] Appl. No.: 371,812

[22] Filed: Apr. 26, 1982

[51] Int. Cl.[3] ..... F27D 1/04

[52] U.S. Cl. ..... 373/44; 373/75

[58] Field of Search ..... 373/75, 76, 72, 44, 373/45; 266/279, 285, 286; 432/248, 252

[56] References Cited

U.S. PATENT DOCUMENTS

| | | | |
|---|---|---|---|
| 3,973,076 | 8/1976 | Scott, Jr. et al. | 373/75 |
| 3,990,686 | 11/1976 | Iguchi et al. | 373/76 |
| 4,375,449 | 3/1983 | Siddall | 373/76 |

*Primary Examiner*—Roy N. Envall, Jr.

*Attorney, Agent, or Firm*—McAulay, Fields, Fisher, Goldstein & Nissen

[57] ABSTRACT

Disclosed is an ore-smelting electrical furnace bath, in which smelting is accomplished with electrodes buried into the melted slag, comprising an externally cooled metallic jacket, a lining forming the walls and the bottom of the bath, and a sealing layer interposed therebetween. The walls of the bath in the melted slag zone are made from graphite-reinforced refractory blocks having a thickness at which the total thermal resistance of these blocks and of the sealing layer ranges from 0.01 to 0.09 $m^2$ hr.deg./kcal. The lower portion of the aforesaid walls and the bottom are made from refractory carbon blocks.

4 Claims, 1 Drawing Figure

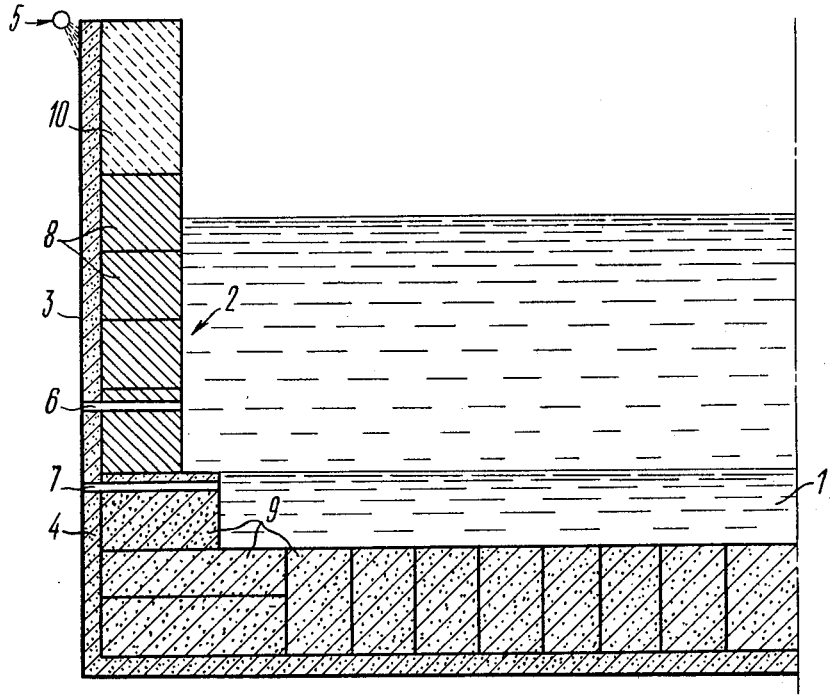
5
10
8
3
2
6
7
4
9
1

ORE-SMELTING ELECTRICAL FURNACE BATH

FIELD OF THE INVENTION

The present invention relates generally to ore-smelting electrical furnaces, in which smelting is accomplished with electrodes buried into the melted slag, and more specifically is concerned with baths for such furnaces, electrical furnaces for the production of ferroalloys and in particular, ferronickel from oxidized nickel ore.

BACKGROUND OF THE INVENTION

It is commonly known that the baths of electrical furnaces are built up from a lining forming a bottom and walls, a metal jacket, and a sealing layer interposed between the jacket and the lining. The baths of such electrical furnaces are provided with openings for discharging slag and a resulting product. The linings of the electrical furnace baths are subjected not only to intensive thermal exposure, but also to corrosion caused by the melted slag. The foregoing conditions cause special problems associated with the protection of these linings from the action of highly aggressive acid melted slags which are typical for the reduction smelting of ferronickel.

Usually for the purpose of enhancing the resistance of the electrical furnace linings intended for operation in the presence of melted slags, these linings are manufactured with the use of magnesite materials, in particular, magnesite or chromomagnesite refractory bricks (see for example "Osnovy metallurgii" ("The Essentials of Metallurgy"), Moscow, 1961, vol. I, part I, pp. 78–82), or a refractory mass composed of magnesite powder and refractory clay (see U.S.S.R. Inventor's Certificate No. 104437 issued Nov. 31, 1956). Such linings of magnesite materials are capable of successfully withstanding comparatively low specific electrical furnace outputs, but, however, should the level of specific output increase up to 70–90 kW/m$^2$, these linings tend to break down from corrosion, particularly in the zone of action of the melted slag.

There are known a number of methods for the protection of electrical furnaces from corrosion effects produced by the melted slag which feature freezing a coat of slag lining onto the internal surface of the lining. This is ensured by withdrawing the flow of heat from this surface by means of cooling. There are different designs for electrical furnace baths operating on this principle.

Known in the prior art are ore-smelting electrical furnace baths in which the lining refractory brickwork in the melted slag zone comprises a plurality of built-in water-cooled elements mounted at a comparatively short distance from the internal surface of this lining, such elements usually include jackets (U.K. Accepted Application No. 1444507 issued Aug. 8, 1976) or coils (U.S.S.R. Inventor's Certificate No. 491012 issued Nov. 5, 1975). In such baths the internal surface of the lining in the melted slag zone develops a sufficiently thick coat of slag lining. However, the built-in water-cooled elements located near the internal surface of the lining tend to cause the risk of developing uncontrolled burn-outs which are attended by the inrush of water into the bath and, as a consequence, by complete breakdown. Furthermore, the provision of numerous inlets and outlets for the circulation of water in such electrical furnace baths makes the task of sealing these baths highly difficult. If, however a complete sealing is not provided, the economic efficiency factors of the electrical furnace operation tend to drop owing to the suction of air. While reviewing the designs of the electrical furnace baths under consideration it should be also taken into account that the provision of built-in water-cooled elements considerably increases the labour and the time required for maintenance and repair.

Also in the prior art is an ore-smelting electrical furnace bath for the smelting of ferroalloys, which comprises a lining made with the use of carbonaceous refractory blocks, a metallic jacket provided with means for external cooling and a sealing layer interposed therebetween (see "Futerovki ferrosplavnykh pechei" (The linings of Ferroalloy Furnaces") in the collection of articles "Information Review of the General Research Institute of Ferrous Metals", Moscow, 1976, Series No. 5, second issue). The above-described electrical furnace bath is closely related to the subject of the present invention. It is comparatively simple in design and in repair, reliably sealed and provides fair conditions for the formation of a protective slag lining coat on the internal surface of the lining.

However, the relatively high resistance displayed by the bath lining of this prior art electrical furnace ensures only up to specific outputs in the range from 100 to 120 kW/m$^2$. This does not allow increasing the output of the electrical furnace and, as a consequence, its efficiency. The bath under consideration makes use of carbon blocks for the carbonaceous refractory blocks. But as the calculations and the experimental investigation data have revealed, with a thickness of carbon blocks ensuring the required mechanical strength and with any material for the sealing layer it becomes impossible, should the level of output exceed of the aforesaid range, to withdraw the desired amounts of heat for freezing a coat of slag lining with a thickness sufficient for the provision of protective functions.

It is an object of the present invention to provide an ore-smelting electrical furnace bath which has improved efficiency levels at the expense of increasing the overhaul period of the lining of the electrical furnace with a high specific output.

Another object of the invention is to provide an ore-smelting electrical furnace bath of the above character featuring safety in operation.

Still another object of the invention is to provide an ore-smelting electrical furnace bath of the above character which has such a fairly simple design that results in a considerable decrease in the consumption of labour as well as in the time required for its maintenance and repair.

Other objects of the present invention will become apparent from the following detailed description of its embodiments.

SUMMARY OF THE INVENTION

Having the foregoing objects in mind there is provided an ore-smelting electrical furnace bath, in which the processes of smelting are accomplished with electrodes buried into the melted slag, comprising a lining made of carbonaceous refractory blocks, a metallic jacket fitted with means for external cooling and a sealing layer interposed therebetween, wherein, in the melted slag zone the carbonaceous refractory blocks are made from graphite-reinforced blocks with a thickness at which the total thermal resistance of the aforesaid blocks and of the sealing layer ranges from 0.01 to 0.09

$m^2$ hr.deg./kcal, while the lower portion of the bath lining is made from carbon blocks. It is known that the thermal resistance of any element is the ratio of a thickness of the element to its thermal conductivity. As experimental studies have revealed, the utilization of the graphite-reinforced blocks in the melted slag zone with the above-specified total thermal resistance of the bath in this zone ensures withdrawal of enough heat to freeze a protective slag lining coat to give a reliable protection of the lining for the most powerful modern electrical furnaces with specific outputs in the range from 200 to 300 kW/$m^2$ and higher. At the same time, the above mentioned combination of the graphite-reinforced blocks with the carbon blocks proves to be optimal since the carbon blocks in the melted metal exhibit a higher level of resistance, and, what is more, they permit to avoid the formation of skulls reducing the extent of the smelting space and increasing labour due to the punching of outlet openings. As used herein the term "thermal resistance" (cf., "Basics of the Heat Exchange Theory" by S. S. Kutateladze, Mashgiz, Moscow 1962, p. 67), means the value of the ratio of the wall thickness $\delta$ to the heat-conductivity factor $\lambda$. The wall thickness $\delta$ is expressed in meters (m), and the heat-conductivity factor $\lambda$ in kilocalories/meter.hour.degree, or in the abbreviation, kcal/m.hr.0°. Therefore, the thermal resistance $\delta/\lambda$ is expressed in $m^2$.hr.0°/Kcal. If the wall consists of several layers, its thermal resistance is equal to the sum of the thermal resistances of the layers. In particular, the thermal resistance of the lining in accordance with this invention in the zone where the melted slag is disposed equals to the sum of the thermal resistances of the graphitized blocks 9 and the sealing layer 4.

As used herein, the term "carbon blocks" means a product used, for instance, for lining walls and bottoms of various furnaces. The term is used in technical literature (cf., "A Reference Book on Carbon-Graphite Materials" by M. I. Rogailyn and E. F. Chalykh, Leningrad, Chemya, p. 80).

The essence of the present invention as well as the foregoing and other objects and advantages thereof will be more clearly understood from the consideration of its succeeding practical embodiments illustrated by the accompanying drawing.

BRIEF DESCRIPTION OF THE DRAWING

The accompanying drawing is a sectional view of an ore-smelting furnace bath according to the present invention.

DETAILED DESCRIPTION OF THE INVENTION

The ore-smelting electrical furnace bath shown in the drawing is intended for the production of ferroalloys by reduction electrical smelting with electrodes buried into the melted slag. The bath comprises a lining formed by a bottom 1 and side walls 2, a metallic jacket 3 and a sealing layer 4 disposed therebetween. The aforesaid bath is also provided with means 5 for cooling the metallic jacket outwardly, which are made in form of a water spraying system. The wall of the bath is fitted for the discharge of slag and metal with respective openings 6 and 7.

The lining of the bath is made from refractory blocks, the portion of the walls 2 disposed in the melted slag zone, according to the present invention, being made from graphite-reinforced refractory blocks 9, and the lower portion of the walls 2 and the bottom 1 being made from carbon refractory blocks 8. The upper portion of the walls 2 extending above the melted slag zone up to the level of the roof of the electrical furnace may be made from any suitable refractory material, for example, such as chamotte bricks 10.

The thickness of the graphite-reinforced refractory blocks 9 should be such as to provide the required mechanical strength and at the same time provide that the total thermal resistance of these blocks and the sealing layer 4 be in the range from 0.01 to 0.09 $m^2$ hr.deg./kcal. The above-specified range has been substantiated by industrial scale ore-smelting experimental research evidence and by electronic computer calculations of temperature fields, thermal flows and thicknesses of slag lining coats in the electrical furnace bath. As the research evidence has shown, with the total thermal resistance of the graphite-reinforced refractory blocks 8 and the sealing layer 4 exceeding the range of 0.09 $m^2$ hr.deg./kcal, irrespective of the rate of cooling of the metallic jacket 3, even at comparatively low specific outputs of the electric furnace, the walls of its bath do not form a slag lining coat sufficient for the reliable protection of the lining from corrosion effects produced by the acid melted slag. On the other hand, if the total thermal resistance of the graphite-reinforced refractory blocks 8 and the sealing layer 4 is lower than the range of 0.3 $m^2$.hr. deg./kcal the slag lining coat proves to be of such thickness that it leads to the formation of skulls making the punching of the openings 6 for discharging slag much more difficult and considerably decreasing the extent of the smelting space.

The thickness of carbon refractory blocks 8 is determined as usual from the standpoint of ensuring the required mechanical strength and proper heat insulation. These conditions are ensured to a sufficient degree with thicknesses of the coal refractory carbon blocks 8 being in the range from 0.9 to 1.5 of the diameter of the electrode of the electrical furnace. For the manufacture of sealing layer 4 use may be made of any suitable material, for example, chamotte filling or brickwork with asbestos. However, in order to decrease the total thermal resistance of the walls 2 of the electrical furnace bath it is more preferable that use be made of a material exhibiting a higher level of thermal conductivity, for example, of a carbonaceous mass which is prepared by mixing finely divided carbonaceous particles with a binder. The thickness of the sealing layer 4 should be such that ensures the desired degree of sealing between the metallic jacket 3 and the lining of the bath.

The above-specified arrangement of the electrical furnace bath according to the present invention and the results obtained from its employment are illustrated by the following specific examples.

EXAMPLE I

The present invention was realized in an industrial electrical furnace for the smelting of ferronickel from oxidized nickel ore, the furnace had a rated power of 9 MW and an area of the bottom of 20 $m^2$ and was provided with 3 electrodes with a diameter of 0.5 m.

The lining of the electrical furnace bath, disposed below the melted slag zone, was made from carbon blocks 9 with a thermal conductivity of 5 kcal/m hr.deg and a thickness of 0.5 m or one diameter of the electrode. The walls 2 above the carbon blocks 9 in the melted slag zone were made from the graphite-reinforced refractory blocks 8 with a thickness of 0.4 m or 0.8 of the diameter of the electrode, these blocks had a thermal conductivity of 25 kcal/m.hr.deg. The sealing layer 4 between the metallic jacket 3 and the lining was made from chamotte crumbs. The layer had a thickness of 0.08 m and a thermal conductivity of 1.1 kcal/$m^2$ hr.deg. The total thermal resistance of the graphite-reinforced blocks 8 and the sealing layer 4 was equal to 0.089 $m^2$.hr.deg./kcal. The upper portion of the walls 2 up to the level of the roof was made from the chamotte bricks 10 of the same thickness as the thickness of the graphite-reinforced blocks 8.

The testing of this electrical furnace was carried out for 6 months at a specific output of the furnace from 175 to 350 kW/$m^2$.

The operation of the electrical furnace proceeded in the normal manufacturing mode at which the consumption of labour and the time taken by slag discharge were usual. During the testing the products of smelting were turned out and the examination of the lining was carried out every month. The steady formation of a slag lining coat with a thickness from 5 to 12 mm and no skulls were revealed.

EXAMPLE 2

The testing was carried out in the same electrical furnace as in Example 1.

However the thickness of the graphite-reinforced blocks 8 was decreased to 0.12 m and the sealing layer 4 was made from a carbonaceous material and had a thickness of 0.02 m. This carbonaceous material was prepared from 85 percent by weight of graphite crumbs resulting from graphite production waste and having a size of 0.5 to 3 mm, and 15 percent by weight of anthracite oil. The carbonaceous mass displayed a thermal conductivity of 3 kcal/m. hr.deg. The total thermal resistance of the graphite-reinforced refractory blocks 8 and the sealing layer 4 amounted to 0.011 $m^2$.hr.deg./kcal.

The testing of this electrical furnace, similarly to Example 1, was carried out for six months at a specific output of the furnace of 175 to 350 kW/$m^2$.

The operation of the electrical furnace proceeded in the normal manufacturing mode at which the consumption of labour and the time taken for slag discharge were usual.

The examination of the lining showed steady formation of a slag lining coat with a thickness from 25 to 30 mm. The initial stages of the formation of skulls were noticed.

EXAMPLE 3

The present invention was realized in an industrial electrical furnace with a rated power of 48 MW, the furnace had a bottom with an area of 200 $m^2$ and was provided with six electrodes with a diameter of 1.2 m. The furnace was intended for the production of ferronickel.

The lining of the electrical furnace bath was made from carbonaceous refractory blocks, with the bottom 1 and the walls 2 up to the level of 0.6 m or 0.5 of the diameter of the electrode, corresponding to the height of the melted metal, being made from carbon blocks 9 with a thickness of 1.6 m or 1.33 of the diameter of the electrode and a thermal conductivity of 5 kcal/m.hr.deg. The walls 2 above carbon blocks 9 in the melted slag zone equal to 1.8 m or 1.5 of the diameter of the electrode were made from the graphite-reinforced blocks 8 with a thickness of 0.55 mm and a thermal conductivity of 25 kcal/m hr.deg. The sealing layer 4 between the metallic jacket 3 and the lining was made from the carbonaceous material similar to that described in Example 2 and having a thermal conductivity of 3 kcal/m hr. deg. and a thickness of 0.1 m. The total thermal resistance of the graphite-reinforced blocks 8 and the sealing layer 4 amounted at that to 0.055 $m^2$.hr.deg/kcal. The wall 2 above the graphite-reinforced blocks 8 up to the level of the roof was made from the chamotte bricks 10 of the same thickness as the thickness of the graphite-reinforced blocks 8.

The electrical furnace with such a bath showed steady and reliable performance at specific outputs of 180 to 220 kW/$m^2$ for four years without any repair of the lining. The slay lining seat in the melted slag zone was equal to 20 mm.

As it follows from the detailed description of the invention, its employment in the baths of electrical furnaces operating in the presence of melted slags enables to form on the walls of the lining of the bath a slag lining coat with a thickness sufficient for the protection of the lining from the corrosion effects produced by the melted slag. Such a coat is formed in a steady and reliable manner at high specific outputs of the furnaces, which allows to increase the outputs of the furnaces and, as a consequence their efficiency. At the same time it appears from the above detailed description that the bath of the electrical furnace according to the present invention is comparatively simple in design and does not differ considerably from the conventional baths of electrical furnaces operating without cooling systems. This ensures convenience for maintenance and little labour and time for this maintenance.

What we claim is:

1. A bath for ore-smelting electrical furnace intended for reduction electrical smelting processes with electrodes buried into the melted slag, comprising a metallic jacket provided with means for its external cooling, a sealing layer adjacent to said jacket, and a lining adjacent to said sealing layer and forming the walls and bottom of the bath, said walls in the melted slag zone being made from graphitized refractory blocks having a thickness at which the total thermal resistance of these blocks and of said sealing layer ranges from 0.01 to 0.09 $m^2$.hr.deg./kcal, said walls below the melted slag zone and said bottom consisting of refractory carbon blocks.

2. The bath of claim 1, wherein said means for cooling consists of a water spraying system.

3. The bath of claim 1, wherein the upper part of said walls extending above the melted slag zone consists of chamotte bricks.

4. The bath of claim 1, wherein the thickness of said refractory carbon blocks consists of ranges from 0.9 to 1.5, the diameter of said electrodes.

* * * * *